US007305194B2

(12) United States Patent
Thayer

(10) Patent No.: US 7,305,194 B2
(45) Date of Patent: Dec. 4, 2007

(54) XEROGRAPHIC DEVICE STREAK FAILURE RECOVERY

(75) Inventor: Bruce Thayer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 284 days.

(21) Appl. No.: 11/166,763

(22) Filed: Jun. 24, 2005

(65) Prior Publication Data

US 2006/0115285 A1 Jun. 1, 2006

Related U.S. Application Data

(60) Provisional application No. 60/631,651, filed on Nov. 30, 2004, provisional application No. 60/631,918, filed on Nov. 30, 2004, provisional application No. 60/631,921, filed on Nov. 30, 2004.

(51) Int. Cl.
*G03G 15/00* (2006.01)

(52) U.S. Cl. ..... 399/49; 399/168; 399/172

(58) Field of Classification Search ..... 399/38, 399/46, 47, 48, 49, 72, 107, 115, 168, 170, 399/172

See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,264,904 A 11/1993 Audi et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,623,721 A 4/1997 Lindblad et al.
5,629,762 A 5/1997 Mahoney et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Hoan Tran
(74) *Attorney, Agent, or Firm*—Fay Sharpe LLP

(57) ABSTRACT

Disclosed is an image forming method for an electrophotographic photoreceptor. The method provides for detecting a first streak in a first image; identifying the first streak location; shifting a charge device and marking a second image; identifying a second streak location; comparing the first streak location with the second streak location and determining a distance therebetween. The method further provides that on a first pass, charging a photoreceptor with the charge device; shifting the charge device from a first position to a second position along the photoreceptor corresponding to the distance; and, on a second pass, charging the photoreceptor with the charge device.

16 Claims, 2 Drawing Sheets

U.S. PATENT DOCUMENTS

| | | | | |
|---|---|---|---|---|
| 5,710,968 | A | 1/1998 | Clark et al. | |
| 5,721,085 | A | 2/1998 | Oshiba et al. | |
| 5,729,815 | A | 3/1998 | Lindblad et al. | |
| 5,778,377 | A | 7/1998 | Marlin et al. | |
| 5,864,741 | A | 1/1999 | Montfort et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,463,240 | B2 | 10/2002 | Onuki et al. | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,980,759 | B2 * | 12/2005 | Kanno et al. | 399/111 |
| 7,072,603 | B2 * | 7/2006 | Tsuzuki et al. | 399/111 |
| 7,106,996 | B2 * | 9/2006 | Funamizu et al. | 399/301 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2004, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.

* cited by examiner

XEROGRAPHIC DEVICE STREAK FAILURE RECOVERY

CROSS REFERENCE TO RELATED APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.; U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N.M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof; U.S. application Ser. No. 11/000,168, filed Nov. 30, 2004, entitled "ADDRESSABLE FUSING AND HEATING METHODS AND APPARATUS," by David K. Biegelsen, et al.; U.S. application Ser. No. 11/000,258, filed Nov. 30, 2004, entitled " GLOSSING SYSTEM FOR USE IN A TIPP ARCHITECTURE," by Bryan J. Roof; U.S. Application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S.application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P.J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P Application Ser. No. 11/137,273, filed May 25, 2005, entitled "PRINTING SYSTEM", by David G. Anderson et al.;

U.S. Publication No. US-2006-0274334 A1, filed Jun. 2, 2005, entitled "INTER-SEPARATION DECORRELATOR", by Edul N. Dalal et al.;

U.S. Publication No. US-2006-0274334-A1, filed Jun. 7, 2005, entitled "LOW COST ADJUSTMENT METHOD FOR PRINTING SYSTEMS", by Michael C. Mongeon;

U.S. Publication No. US-2006-0280517-Al, filed Jun. 14, 2005, entitled "WARM-UP OF MULTIPLE INTEGRATED MARKING ENGINES", by Bryan J. Roof et al.;

U.S. application Ser. No. 11/56,778, filed Jun. 20, 2005, entitled "PRINTING PLATFORM", by Joseph A. Swift;

U.S. Publication No. US-2006-0285159-A1, filed Jun. 21, 2005, entitled "METHOD OF ORDERING JOB QUEUE OF MARKING SYSTEMS", by Neil A. Frankel.

BACKGROUND

The present device and method relates to forming images by the use of xerographic or electrophotographic processes, which are used in copying machines, printers, etc.

Heretofore, in the method of image formation by the use of electrophotographic process, streaks can be caused by charge device failures. A common failure mode for charge devices creates streaks on prints due to local contaminants on the charge device. The streak defect is due to insufficient charging at the location of the contaminant on the charging element (wire, pin, etc.). If left alone these failures become more severe with additional usage. Various cleaning devices have been used in an attempt to prevent the build up of contaminants and to remove contaminant deposits from the charge device charging elements (wires, pins, etc.).

The present disclosure proposes a device and method for recovery from a streak defect caused by charge device failures. The present disclosure provides a method of forming images, and an apparatus used therefor, whereby images with improved image quality and high durability can stably be obtained even during repeated image-forming operations without causing degradation in the image due to streaks caused by charge device failures.

BRIEF DESCRIPTION

In accordance with the present description, there is disclosed an image forming method for an electrophotographic photoreceptor, comprising: detecting a first streak in a first image; identifying the first streak location; shifting a charge device and marking a second image; identifying a second streak location; comparing the first streak location with the second streak location and determining a distance therebetween; on a first pass, charging a photoreceptor with the charge device; shifting the charge device from a first position to a second position along the photoreceptor corresponding to the distance; and, on a second pass, charging the photoreceptor with the charge device.

In accordance with another aspect of the present description, a printing system is provided comprising: a charge device adapted for charging the surface of a photoreceptor; the photoreceptor includes a central axis therethrough; the charge device includes a length of travel for translating along another axis parallel to the central axis; the charge device includes a first end having a first shield; and, the charge device includes a second end having a second shield, the first shield opposed to the second shield wherein the first and second shields adapted to prevent arcing of the charge device with the photoreceptor.

In accordance with yet a further aspect, a xerographic method is provided comprising: detecting a first streak in a first image; identifying the first streak location; selecting a first color charge device from a plurality of color charge devices; shifting the first color charge device associated with one photoreceptor and marking a second image; identifying a second streak location; comparing the first streak location with the second streak location and determining a distance therebetween; on a first pass, charging a photoreceptor with the plurality of color charge devices; shifting the first color charge device from a first position to a second position along the photoreceptor corresponding to the distance; and, on a second pass, charging the photoreceptor with the first color charge device.

DETAILED DESCRIPTION

The present disclosure provides a method for recovery from a streak defect caused by charge device failures. The recovery is enabled by implementing two photoreceptor passes under the charge device. On the second pass the charge device is shifted in its inboard-outboard position so that the defective area aligns with an operating portion of the device. The print defect can be detected by a machine sensor and the charge device can be shifted automatically until the sensor no longer detects the defect. Alternatively, the user could detect the defect and be instructed by the machine or printer through a process to determine the amount of shift. This remedy is intended to provide the user with good print quality and continued up time, although at half speed, until a repair can be made to permanently correct the problem. The charge device shift capability can also be used in diagnostic procedures to identify the cause of the defect.

Figure 1:
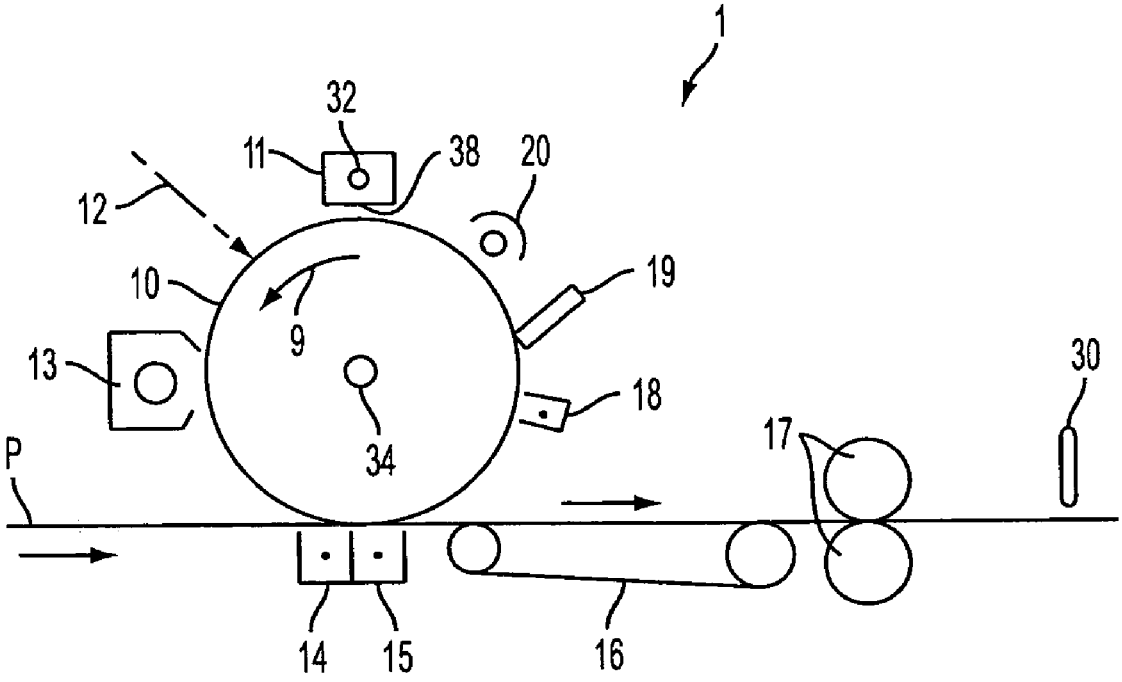
FIG. 1 is a structural schematic view displaying the mechanism of the photoreceptor according to the present disclosure; and, FIG. 2 is a flow chart explaining the method according to the present disclosure.
Figure 2:
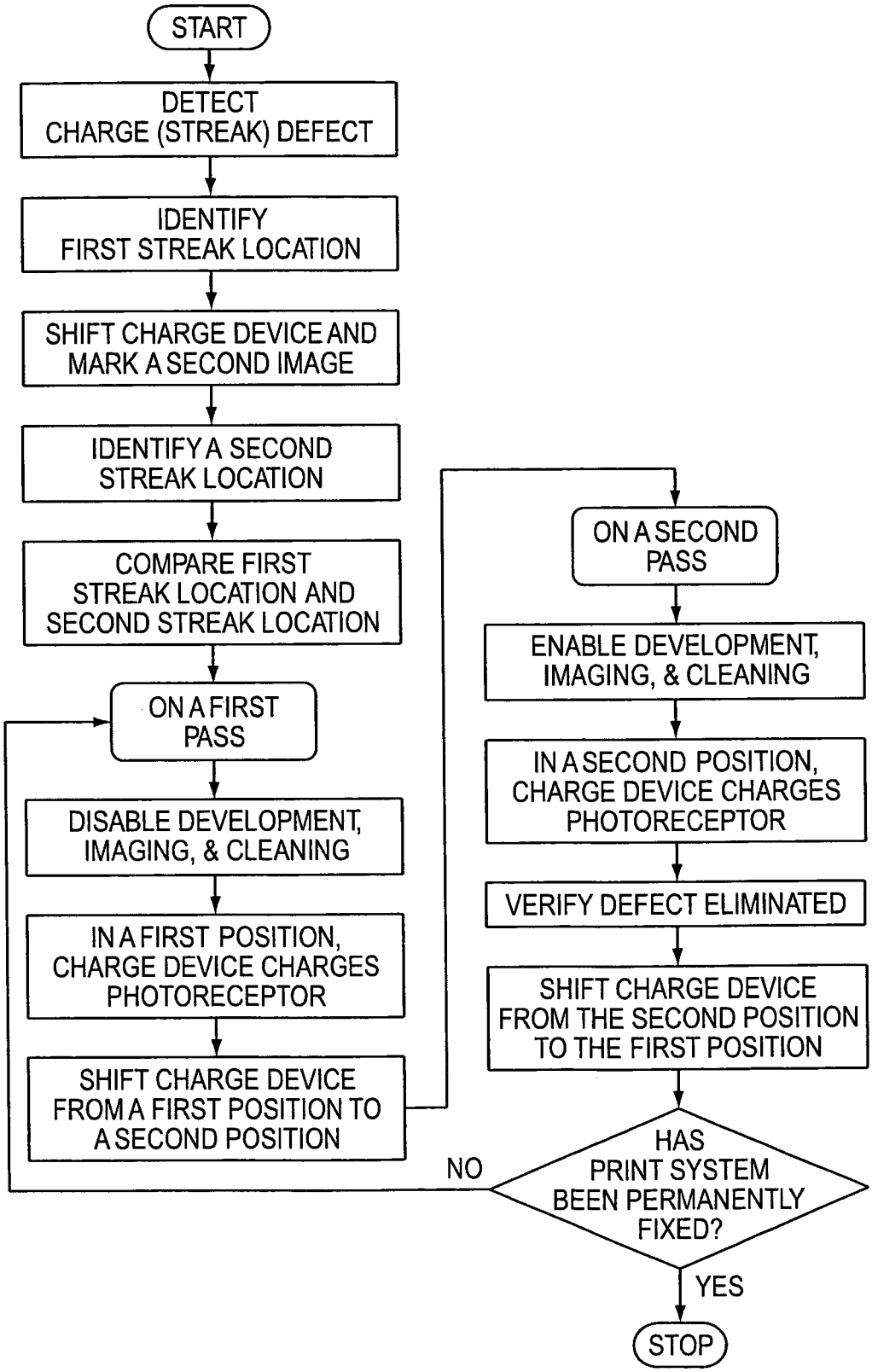

The following process steps describe the operation and apparatus for implementing recovery from streak defects caused by localized charge device failures. FIG. 1 shows a schematic structural drawing of a xerographic process 1. In FIG. 1, numerical symbol 10 denotes a photoreceptor which rotates in the direction of the arrow 9. It is to be appreciated that the photoreceptor can be either a drum type or a belt type photoreceptor. An electrification or charge device 11 confers uniform electric charge on the above-mentioned photoreceptor 10. This charge device 11 may be a corona discharging and/or electrification device, a roller electrification device or a magnetic brush electrification device. An analogue image-exposure or a digital image exposure is denoted at 12. By utilizing the image exposure 12, an electrostatic latent image is formed on the surface of the photoreceptor 10. This electrostatic latent image can be developed by either contact developing process or non-contact developing process, by using a developing unit 13 containing a developer, which may be either a one-component-type or a two-component-type developer, thus so as to form a toner image on the above-mentioned photoreceptor 10. The toner image can be electrostatically transferred onto a transfer material p with a transfer device 14 (transfer device using corona discharger or a roller transfer device), separated with a separation electrode 15 and transported to a fixing or fusing unit 17 by a transport means 16, thereby to fix the transferred toner image.

After transfer of the toner image, the surface of the photoreceptor 10 can be subjected to discharge with a discharging device 18 and, then cleaned by contacting with a cleaning blade 19 in the counter direction to that of the above-mentioned photoreceptor 10. Then, the surface of the photoreceptor can be discharged by a discharging lamp 20 so as to enter in the stand-by condition for preparing next image formation.

The failure recovery process includes detecting streak failures on prints. Output print quality sensors 30 can be a full width array sensor or other sensing scheme including the user's visual observation. Once the location of the streak failures are noted, the failure location(s) can be retained in machine memory or the user can retain original defective prints. In order to recover from the streak defect, the charge device can be shifted in the inboard-outboard directions along an axis 32. Axis 32 is parallel to and offset from a central axis 34 extending through photoreceptor 10. It is to be appreciated that the dimension or amount of shift to the charge device will be at least as much as the width of the streak. Although the shift dimension is variable and responsive to the width of the streak to be corrected, the typical dimension of shift will be on the order of 4-12 mm.

The charge device 11 can have a shield 38 on each end to prevent arcing when one of the ends of the charge device 1, after shifting, is positioned over grounding elements (not illustrated) at opposing ends of the photoreceptor 10.

The location of streak failure after charge device shift is noted. The failure location can be retained in machine memory or customer can retain original defective prints. The original failure location can be compared to location after charge shift. If the location did not change by shift dimension, then the streak defect is due to a cause other than the charging device.

If the charge device 11 is the cause of the failure, then the machine operates in two pass charging mode. A remedial shift dimension is determined. The magnitude of shift is determined by referring to original streak location from the sensor 30. The shift will move the defect into a defect free region.

The first pass of the charge device 11 provides for normal charging, in a first position, without imaging, development, or cleaning. Normal charging is provided in the original or starting position for the charge device 1. The development is disabled including bias change, brush roll-back, cam housing away, etc. The transfer device 14 is also disabled. Additionally, cleaning is disabled including, for example, restricting action for blade cleaner 19, possible bias change for ESB cleaner, and change to charge bias polarity.

The second pass provides for normal charging in a second position, i.e. shifted device position. The charging can then be followed by normal imaging, developing, transferring, and cleaning. The resultant output print image can then be reviewed in order to verify that the defect has been eliminated. The verification can be by way of sensor 30 or user observation.

The first pass charges the photoreceptor uniformly except in the local areas of charge device failure. In these areas the photoreceptor is uncharged or charged to a low level. In a discharge area development (DAD) system this will result in the development of streaks of toner across the print in the process direction. A charge area development (CAD) system will exhibit light streaks across the print. For the first charging pass all of the other xerographic elements must be disabled to the extent that they do not significantly modify the photoreceptor charge level or uniformity.

The second charging pass returns to normal xerographic operation with the exception that the charge device is shifted. Most of the photoreceptor surface will be fully charged as the photoreceptor enters the charger for the second pass. Since the defects in the charger are no longer aligned to the low charge areas on the photoreceptor, the low charged areas are brought up to full charge on the second pass. Following the second charging pass the photoreceptor charge uniformity will be improved. It is to be appreciated that the charge device includes a charging width (not illustrated) and the photoreceptor includes a charging region (not illustrated). The charging width dimension is greater or larger than the charging region in order to enable photoreceptor charge uniformity over the entire charging region.

In color xerographic systems the missing or additional color streak in the output print will indicate which color charger has failed. Similar to the above described method, a first color charge device can be selected from a plurality of color charge devices (i.e. four color charge devices) for shifting and charging along a photoreceptor. Likewise, each of the other color charge devices, from the plurality of charge devices, can charge the photoreceptor on a first pass and can then be shifted for subsequent charging on a second pass.

The implementation of the aforementioned process can be automatic. The quality of the output prints can be continuously monitored with sensors 30. When a streak defect is detected the cause of the defect is traced to the charge device 11 by shifting the device. A shift in the defect on the print by the amount that the charge device shifts indicates the charge device 11 is a fault. The machine logic can automatically determine a charge device shift amount that will result in elimination of streak defects with two pass charging. The machine timing is changed to disable elements not needed during the first pass and enable them again on the second charging pass. The machine advises the user that a defect has been detected and has been corrected by running the machine at half speed. The user can continue to run the machine in the normal manner with the exception of the decrease in productivity. The user is also advised to call for service so that a repair can be made to eliminate the streak defect and return the machine to full productivity.

The above described process can alternatively be implemented without an output print quality sensor 30 or scanner. In this alternative process, the user manually (visually) performs the print quality function. The user can verify the charge device as the failure cause by comparing locations of the print defect before and after charge device shifting. The user can then vary the charge device shift until the defect is eliminated when running in two pass charging mode. The user can be assisted through the review steps by machine prompts.

The capability of shifting the charge device, especially with the output quality sensor scanner 30, provides an opportunity for self-diagnosis of faults by the machine. It also simplifies diagnostic procedures for the service of the xerographic machine. By running in a two pass charging mode, the user is provided with a machine that is 'never' down. The productivity is albeit reduced until the charging device failure can be permanently repaired. The two pass charging mode continues to allow high quality prints to be made.

The above described process can enable half-speed never down operation in the event of, for example, coronode point defects and can improve reliability. The process is particularly adapted to correct low-charging regions. It is to be appreciated that the process can enable, for example, an integrated pair of printers to run at three quarter speed (75% of normal output), i.e. one printer at full speed and one printer at half speed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic method comprising:

detecting a first streak in a first image;

identifying said first streak location;

shifting a charge device and marking a second image;

identifying a second streak location;

comparing said first streak location with said second streak location and determining a distance therebetween;

on a first pass, charging a photoreceptor with said charge device;

shifting said charge device from a first position to a second position along said photoreceptor corresponding to said distance; and, on a second pass, charging said photoreceptor with said charge device.

2. The method of claim 1, wherein said shifting includes translating said charge device inboard and outboard along an axis, said axis parallel to a central axis extending through said photoreceptor.

3. The method of claim 2, further comprising:

shifting said charge device from said second position to said first position.

4. The method of claim 1, further comprising:

disabling both imaging and developing of an image on said first pass.

5. The method of claim 4, further comprising:

enabling both imaging and developing of said image on said second pass.

6. The method of claim 1, wherein detecting said first streak comprises a sensor, said sensor is a full width array sensor.

7. A printing system comprising;

a charge device adapted for charging the surface of a photoreceptor;

said photoreceptor includes a central axis therethrough;

said charge device includes a length of travel for translating along another axis parallel to said central axis;

said charge device includes a first end having a first shield; and, said charge device includes a second end having a second shield, said first shield opposed to said second shield wherein said first and second shields adapted to prevent arcing of said charge device with said photoreceptor.

8. The printing system of claim 7, wherein said charge device includes a charging width and said photoreceptor includes a charging region, said charging width is greater than said charging region.

9. The printing system of claim 7, wherein said first shield and said second shield positioned between said charge device and said photoreceptor.

10. A xerographic method comprising:

detecting a first streak in a first image;

identifying said first streak location;

selecting a first color charge device from a plurality of color charge devices;

shifting said first color charge device associated with one photoreceptor and marking a second image;

identifying a second streak location;

comparing said first streak location with said second streak location and determining a distance therebetween;

on a first pass, charging a photoreceptor with said plurality of color charge devices;

shifting said first color charge device from a first position to a second position along said photoreceptor corresponding to said distance; and, on a second pass, charging said photoreceptor with said first color charge device.

11. The method of claim 10, wherein said shifting includes translating said first color charge device inboard and outboard along an axis, said axis parallel to a central axis extending through said photoreceptor.

12. The method of claim 11, further comprising:

shifting said first color charge device from said second position to said first position.

13. The method of claim 10, further comprising:

disabling both imaging and developing of an image on said first pass.

14. The method of claim 13, further comprising:

enabling both imaging and developing of said image on said second pass.

15. The method of claim 10, wherein said detecting said first streak comprises a sensor, said sensor is a full width array sensor.

16. The method of claim 10, further comprising:

detecting a first streak in a first image;

identifying said first streak location;

selecting at least a second color charge device from said plurality of color charge devices; and, shifting said at least second color charge device associated with another photoreceptor and marking a second image.

* * * * *